US006325245B1

(12) United States Patent
Matthews

(10) Patent No.: US 6,325,245 B1
(45) Date of Patent: Dec. 4, 2001

(54) SOAP DISPENSER WITH A CLAM-SHELL COVER

(75) Inventor: Shaun Kerry Matthews, Oswestry (GB)

(73) Assignee: Deb IP Limited, Belper (GB)

( * ) Notice: Subject to any disclaimer, the term of this patent is extended or adjusted under 35 U.S.C. 154(b) by 0 days.

(21) Appl. No.: 09/773,927

(22) Filed: Feb. 2, 2001

(51) Int. Cl.[7] ..... B67D 5/08
(52) U.S. Cl. ..... 222/52; 222/181; 222/181.3
(58) Field of Search ..... 222/39, 52, 78, 222/105, 181, 181.2, 181.3, 183, 207, 214, 325

(56) References Cited

U.S. PATENT DOCUMENTS

| | | | | |
|---|---|---|---|---|
| 3,540,630 | * | 11/1970 | Brown et al. | 222/181 |
| 4,741,461 | * | 5/1988 | Williamson et al. | 222/181 |
| 5,248,066 | * | 9/1993 | Olson et al. | 222/105 |
| 5,421,489 | * | 6/1995 | Holzner, Sr. et al. | 222/181 |
| 6,131,773 | * | 10/2000 | Wade et al. | 222/181.3 |

OTHER PUBLICATIONS

Kimberly–Clark®, Dispensing Systems.

Kimberly–Clark®, System 500, Production Description Sheet.

* cited by examiner

*Primary Examiner*—Philippe Derakshani
*Assistant Examiner*—Thach H Bui
(74) *Attorney, Agent, or Firm*—Nancy E. Hill; Hill & Schumacher

(57) ABSTRACT

A soap dispenser is used in association with a pump operated bottle of liquid soap. The soap dispenser includes a back plate, a cover, a pump mechanism and an outer shell. The cover is releasably attached to the back plate. The cover and the back plate define a volute therebetween. The pump operated bottle is positioned in the volute and the pump mechanism is operably connected to the bottle. There is a means to operate the pump mechanism to dispense soap. The outer shell extends over a portion of the cover and is releasably attached thereto. The outer shell can be interchanged with a plurality of similar outer shells. There is a seal between the outer shell and the cover. The outer shell may have a window formed therein and a printed sheet or advertising sheet may be positioned behind the window. Alternatively, the outer shell may have a logo or other design thereon.

16 Claims, 4 Drawing Sheets

16
24
28
30
32
34
36
18
20
22
26
40
42
44
46
48
50
52
54
56
58
76
78
80
82
5
6
7

SOAP DISPENSER WITH A CLAM-SHELL COVER

FIELD OF THE INVENTION

This invention relates to soap dispensers and in particular soap dispensers with covers that can be readily changed to display printed matter or to complement the surrounding decoration.

BACKGROUND OF THE INVENTION

Soap dispensers are well known and are primarily used in industrial and commercial settings. Initially the design of soap dispensers was functional. Thereafter more attention was paid to the aesthetic appearance of the soap dispensers. Increasingly, particularly for commercial setting, the aesthetic appearance of the soap dispenser is very important. Therefore it is important to have a soap dispenser that is both functional and aesthetically pleasing.

To that end, Scott™ introduced a soap dispenser with a central band that can swing open and that has a plasticized sheet inserted therebehind. Although this soap dispenser allows the users to modify the appearance somewhat, changing the colour of the band does not materially change the overall look of the soap dispenser. Further, the swinging band loosely fits into the cover and therefore water or cleaning fluid can easily migrate behind the band during cleaning. Therefore any sheet that is inserted behind the band must be plasticized or coated so that it cannot be ruined by water and the like.

It is noted that increasingly, advertising is found in many public places. Often in washrooms there is advertising in the toilet stalls and other places. Heretofore, the soap dispensers have not been used to display advertising. Accordingly, an opportunity in regard to advertising has been missed.

Accordingly, it would be advantageous to provide a soap dispenser that includes a cover that can be easily changed to co-ordinate with the decor. Further it would be advantageous to provide a soap dispenser that includes a place to display advertising and wherein that advertising may be something easily printed on any type of sheet.

SUMMARY OF THE INVENTION

The soap dispenser of the present invention is used in association with a pump operated bottle of liquid soap. The soap dispenser includes a back plate, a cover, a pump mechanism and an outer shell. The cover is releasably attached to the back plate. The cover and the back plate define a volute therebetween. The pump operated bottle is positioned in the volute and the pump mechanism is operably connected to the bottle. There is a means to operate the pump mechanism to dispense soap. The outer shell extends over a portion of the cover and is releasably attached thereto. The outer shell can be interchanged with a plurality of similar outer shells. There is a seal between the outer shell and the cover. The outer shell may have a window formed therein and a printed sheet or advertising sheet may be positioned behind the window. The outer shell may have a logo or other design thereon.

Further features of the invention will be described or will become apparent in the course of the following detailed description.

BRIEF DESCRIPTION OF THE DRAWINGS

The invention will now be described by way of example only, with reference to the accompanying drawings, in which.

DETAILED DESCRIPTION OF THE INVENTION

Figure 1:
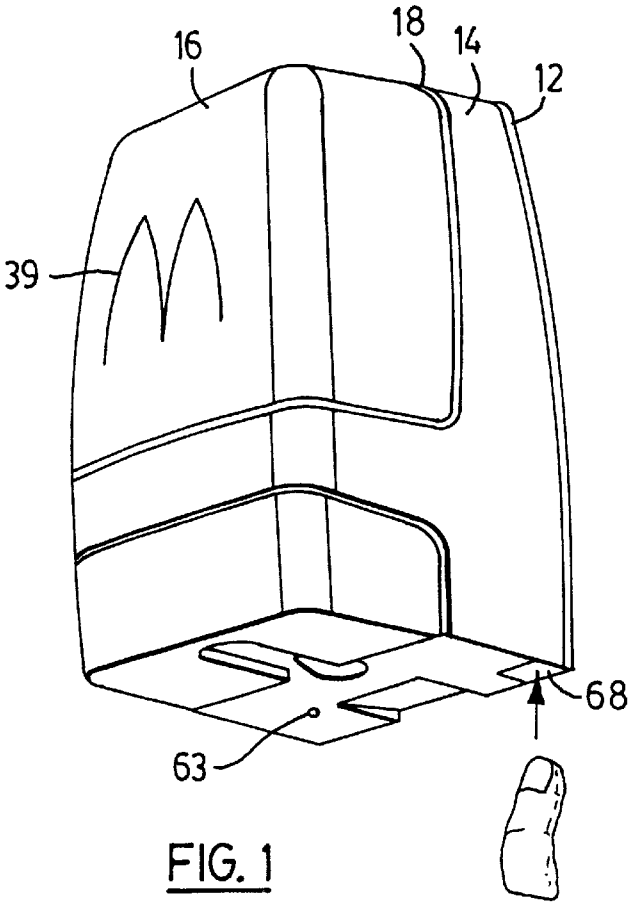
FIG. 1 is a perspective view of the soap dispenser with an outer shell cover constructed in accordance with the present invention.

Referring to FIG. 1, the soap dispenser with a clam-shell cover is shown generally at 10. The cover includes a back plate 12, a cover 14 and an outer shell 16. The back plate 12 and the cover 14 define a volute therebetween.

Figure 3:
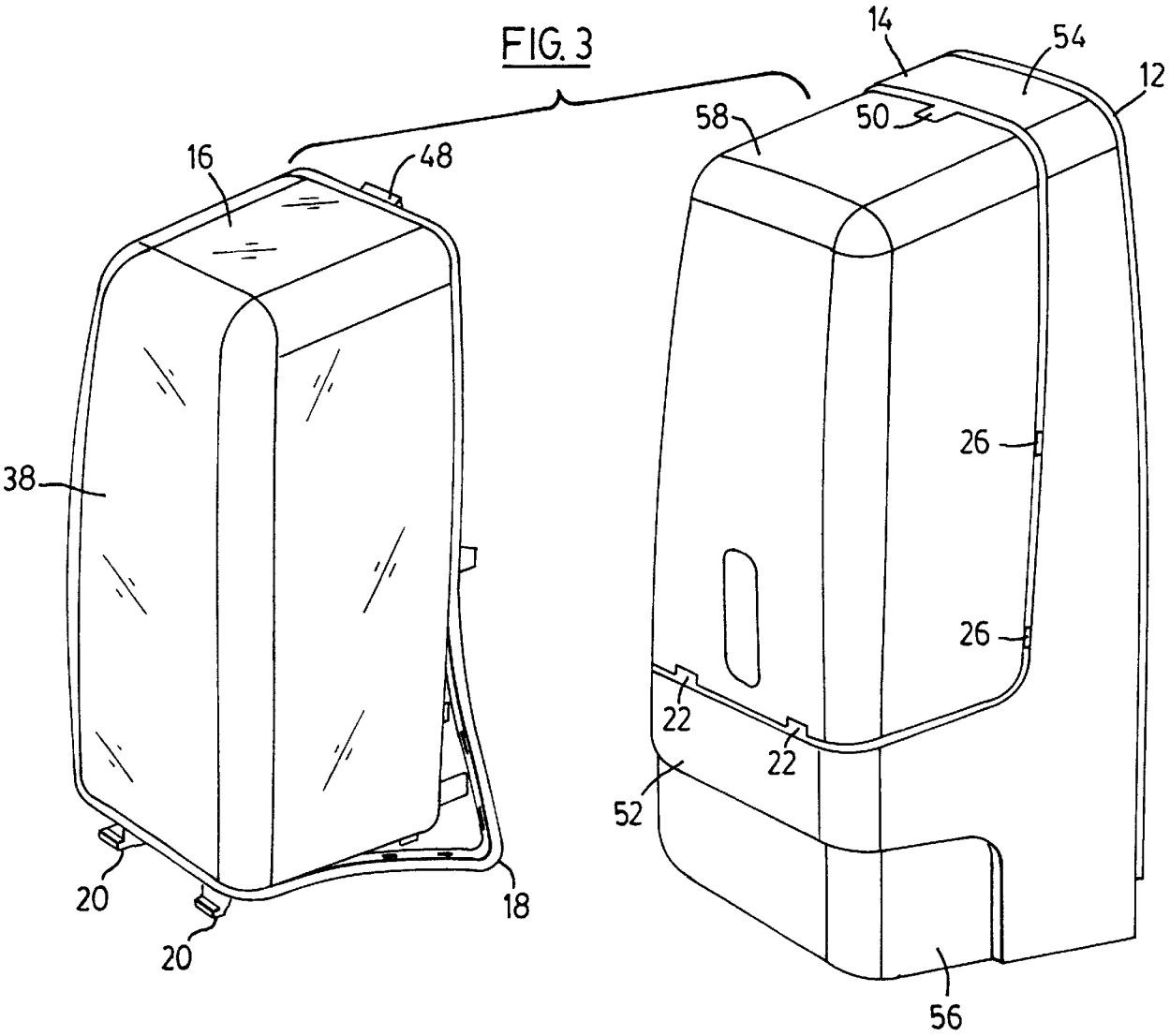
FIG. 3 is a perspective view of an alternate embodiment of the soap dispenser with an outer shell cover having a translucent outer shell and showing the clam shell cover blown apart.
Figures 4, 5, 6, 7:
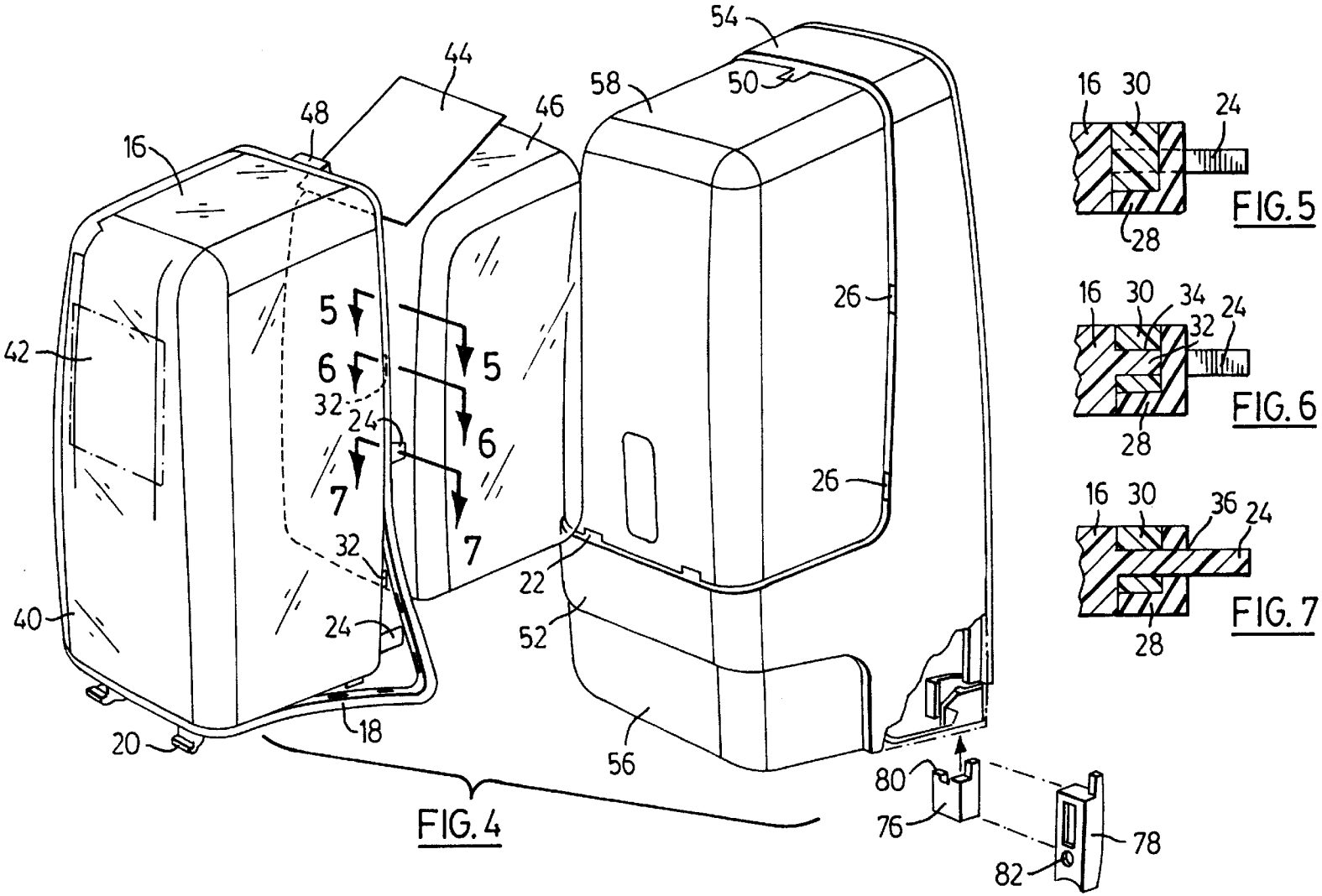
FIG. 4 is a perspective view of an alternate embodiment of the soap dispenser with an outer shell cover having a window formed therein and showing the clam shell cover blown apart.
FIG. 5 is a partial sectional view of the outer shell showing a detail of the seal taken along line 5—5 of FIG. 4.
FIG. 6 is a partial sectional view of the outer shell showing a detail of the seal through a seal spur taken along line 6—6 of FIG. 4.
FIG. 7 is a partial sectional view of the outer shell showing a detail of the seal through a shell spur taken along line 7—7 of FIG. 4.

Referring to FIGS. 3 and 4, the outer shell 16 has a seal 18 around its perimeter. A pair of hooks 20 extend downwardly from the bottom of the removable cover and engage a pair of apertures 22 formed in the cover 14. A plurality of shell spurs 24 extend outwardly from the shell 16 and when assembled are in registration with spur apertures 26 formed in the cover 14. Preferably the outer shell is made from rigid plastic.

The seal 18 has an outer portion 28 and an inner portion 30, as best seen in FIGS. 5–7. Preferably the inner portion is made from a hard rigid material such as ABS plastic and the outer portion 28 is made from a resiliently deformable material, preferably an elastomer. A plurality of seal spurs 32 extend outwardly from shell 16 but do not extend through the outer portion 28 of seal 18. A plurality of seal spur notches 34 and shell spur holes 36 are formed in the seal 18 in registration with the seal spurs 32 and shell spurs 24 respectively. The seal spurs 32 and notches 34 and the shell spurs 24 and holes 26 help to keep seal 18 in position. The seal 18 around the outer shell 16 reduces the possibility of water seeping in behind the outer shell 16 when the soap dispenser is washed in situ.

One advantage of the soap dispenser herein is its versatility. The user can easily remove the shell 16 and replace it with a new shell having a design that coordinates with the decor or with the user's logo or other art work. As an example, the well known golden arches of McDonald's™ is shown in FIG. 1 at 39. Alternatively the user can change the shell 16 from a solid shell as shown in FIG. 1 to a translucent shell 38 as shown in FIG. 3 or to a shell 40 with a window 42 formed therein.

Referring to FIG. 4, the window 42 allows the user to position printed material 44 therebehind. A liner 46 is provided to aid in holding the printed material 44 in place. The window 42 is provided so that the user can easily insert printed matter that can be seen through the window 42. This is particularly useful in regard to providing an advertising opportunity. The printed matter can be anything the user wishes to insert in the window and can be simply printed on a laser or other type of printer. No special paper or special treatment is required. However, it will be appreciated that, if the user wishes, special paper and/or special finishes could also be used.

An upper latch 48 extends outwardly from the top of outer shell 16. Upper latch 48 fits through latch aperture 50 and engages cover 14. Shell 16 is released by pushing down on latch 48.

Figure 2:
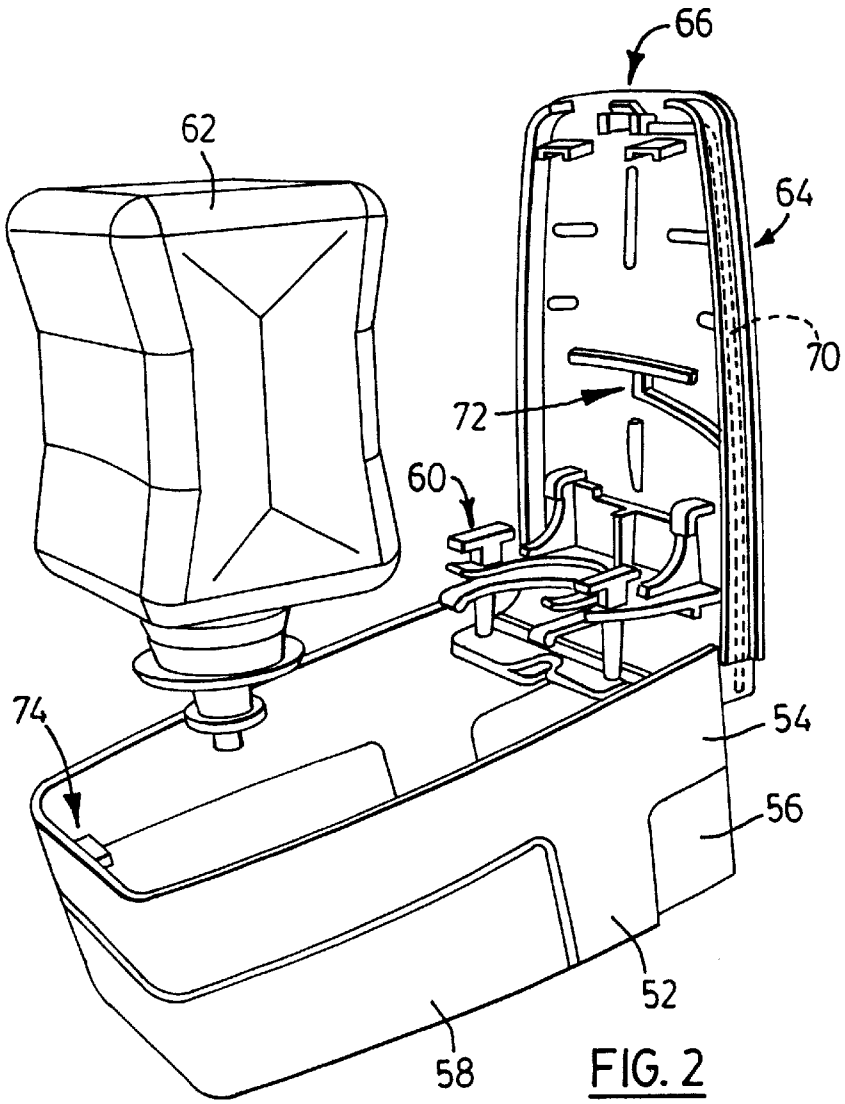
FIG. 2 is a perspective view of the soap dispenser with an outer shell cover, showing the loading of the soap container.

Cover 14 includes an outer bar 52, a back bar 54, a lever 56 and an under shell portion 58. Lever 56 is hingeably attached to the cover such that pushing the lever 56 upwardly engages a pump mechanism 60 that in turn engages the pump operated bottle 62 therein and causes soap to be dispensed, as best seen in FIG. 2. It will be appreciated by those skilled in the art that the soap dispenser herein can be used with either a liquid soap pump mechanism and bottle or a foamed soap pump mechanism and bottle.

Alternatively a sensor 63 shown in FIG. 1 may be used for sensing when the user's hands or other object is within a predetermined range of the soap dispenser. The sensor is operably connected to the pump mechanism 60 such soap is dispensed when an object is within the predetermined range.

Under shell portion 58 is spaced inwardly from the outer bar 52 and the back bar 54 such that when outer shell 16 is attached to cover 14 the outer surface of each is generally in the same plane.

The back plate 12 is adapted to be attached to a wall. It can be attached in any way convenient to the user. For example, screw, adhesives or the like could be used. The pump mechanism 60 is attached to the back plate 12 and the pump operated bottle 62 sits therein.

Referring to FIG. 2, a latching mechanism 64 is used to secure and release the cover 14 to back plate 12. Latching mechanism 64 includes a movable latch 66, a button 68 (best seen in FIG. 1) and a flexible rod 70 extending therebetween. A guide 72 is attached to flexible rod 70 to keep it in position. Movable latch 66 engages closure spur 74 on cover 14. In use, the user pushes button 68 upwardly, causing the flexible rod 70 to move upwardly and the movable latch 66 to pivot to release closure spur 74.

As shown in FIG. 4, two alternate buttons 68 may be used. Some users prefer to have a button always available so that the cover 14 can be opened at any time. Alternatively, some users prefer to limit access to the soap bottle 62 and a removable button which is inserted to provide access to the bottle and removed before closing thereby limiting access to the bottle. Limiting access to the printed material 44 is desirable, particularly where it includes advertising. One button 76 is designed to be left in situ and the other button 78 is designed to be removed. Button 76 includes a latch 80 that serves to keep the button in position once it is inserted. The bottom of button is flush with the bottom of cover 12 when it is in situ. Button 78 is extended such that when it is in situ the longer portion extends below the cover 12. Button 78 includes a hole 82 formed therein so that is can be put on a key ring so as to be easily available to cleaner or the custodian or the like.

Figure 8:
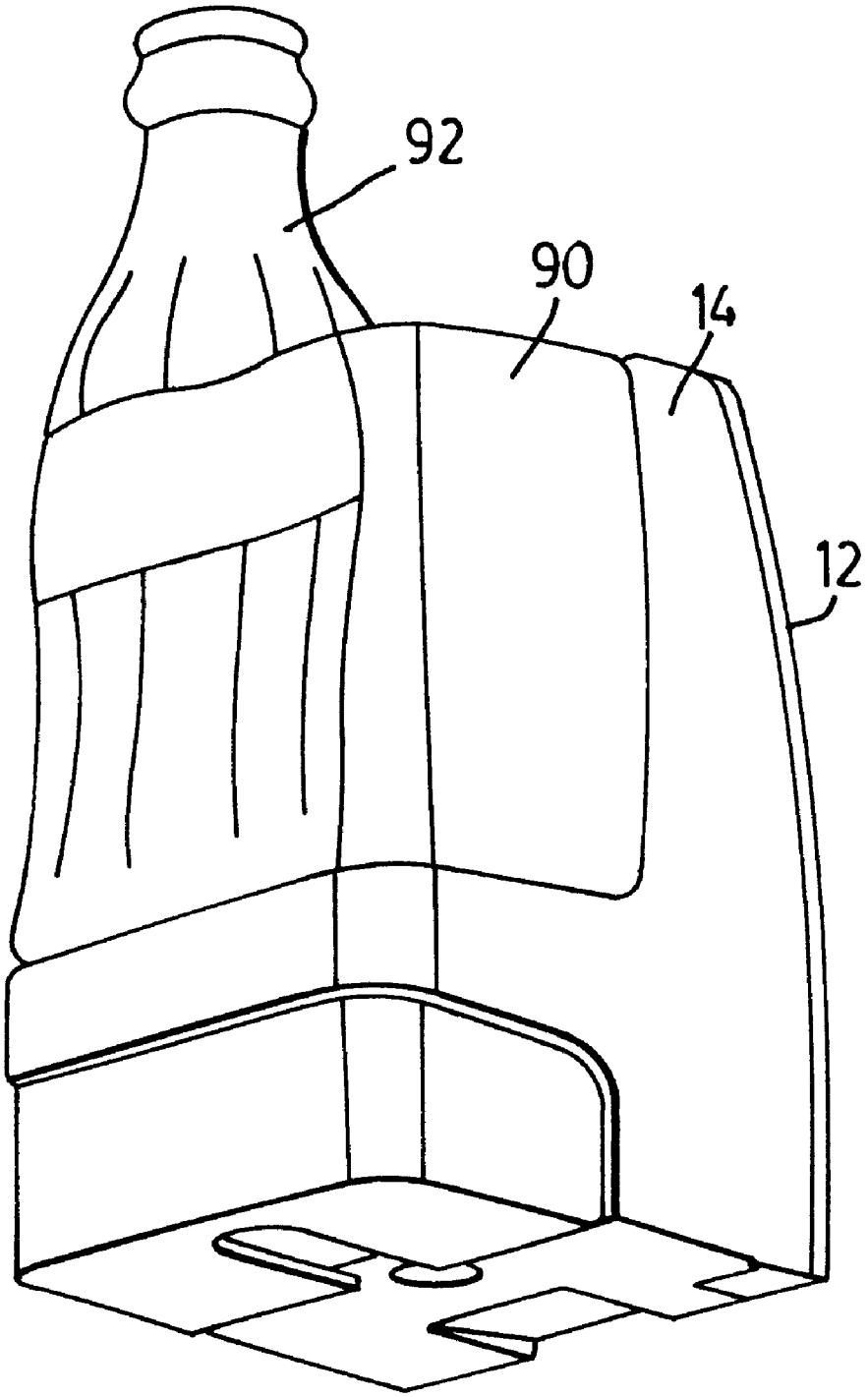
FIG. 8 is a perspective view of an alternate embodiment of the soap dispenser with an outer shell cover constructed in accordance with the present invention showing an irregularly shaped outer shell.

It will be appreciated by those skilled in the art that the outer shell can have a variety of different shape as long as it has hooks 20, latch 48, the inside surface of the shell fits over the under shell portion 58 and the perimeter seal 18 mates with the cover 14. An example of an irregularly shaped outer shell is shown in FIG. 8 at 90 wherein a distinctive bottle shape 92 extends upwardly from the outer shell. The outer shell 90 has an outer surface and an inner surface (not shown) and the shape of the outer surface is different from the shape of the inner surface. The shape of the inner surface corresponds to the shape of an inner portion of the cover 14. The example shown herein has a cover 14 and back plate 12 that is a standardized size to facilitate the manufacturing of each. However, it will be appreciated by those skilled in the art that the shape of the cover 14 and back plate 12 can also be varied.

It will be appreciated that the above description related to the invention by way of example only. Many variations on the invention will be obvious to those skilled in the art and such obvious variations are within the scope of the invention as described herein whether or not expressly described.

What is claimed as the invention is:

1. A soap dispenser for use in association with a pump operated bottle of liquid soap comprising:

a back plate;

a cover releasably attached to the back plate defining a volute therebetween wherein the pump operated bottle is positioned in the volute;

a pump means for pumping the pump operated bottle; and an outer shell extending over a portion of the cover and releasably attached thereto whereby the outer shell can be interchanged with a plurality of similar outer shells.

2. A soap dispenser as claimed in claim 1 further including a seal between the outer shell and the cover.

3. A soap dispenser as claimed in claim 2 wherein the outer shell has a window formed therein and the outer shell and cover are adapted to receive a printed sheet therebetween.

4. A soap dispenser as claimed in claim 3 further including a liner positioned between the outer shell and the cover for holding the printed sheet in place.

5. A soap dispenser as claimed in claim 4 wherein the printed sheet is printed advertising.

6. A soap dispenser as claimed in claim 1 wherein the outer shell has advertising attached thereto.

7. A soap dispenser as claimed in claim 1 wherein the outer shell has a window formed therein and the outer shell and cover are adapted to receive a printed sheet therebetween.

8. A soap dispenser as claimed in claim 7 wherein the printed sheet is printed advertising.

9. A soap dispenser as claimed in claim 3 wherein the printed sheet is printed advertising.

10. A soap dispenser as claimed in claim 1 further including latching mechanism between the back plate and the cover for holding the cover in place including a button whereby depressing the button releases the cover.

11. A soap dispenser as claimed in claim 10 wherein the button is removable when the cover is in an open position and insertable when the cover is in a closed position.

12. A soap dispenser as claimed in claim 10 wherein the latching mechanism includes a button seat adapted to receive both of the removable button and a non-removable button and whereby the user chooses the button.

13. A soap dispenser as claimed in claim 1 wherein the cover includes a lever hingeably attached thereto and the lever operably engages a pump mechanism connected to the pump operated deformable bottle positioned in the soap dispenser and the pump means includes the lever and the pump mechanism.

14. A soap dispenser as claimed in claim 13 further including a sensor for sensing an object within a predetermined range of the soap dispenser and the sensor operably connected to the pump operated deformable bottle when positioned in the soap dispenser and the pump means includes the sensor whereby moving an object into the predetermined range causes pumping of the pump operated bottle.

15. A soap dispenser as claimed in claim 1 wherein the outer shell has an outer surface and an inner surface and the shape of the inner surface corresponds to the shape of an inner portion of the cover and the outer surface has a shape that is different from the shape of the inner surface.

16. A soap dispenser as claimed in claim 2 wherein the outer shell has an outer surface and an inner surface and the shape of the inner surface corresponds to the shape of an inner portion of the cover and the outer surface has a shape that is different from the shape of the inner surface.

* * * * *